US011215327B1

(12) United States Patent
Wang

(10) Patent No.: US 11,215,327 B1
(45) Date of Patent: Jan. 4, 2022

(54) BULB CORE COLUMN STRUCTURE AND BULB WITH THE SAME

(71) Applicant: DONGGUAN HUIHUAN LIGHTING CO., LTD., Dongguan (CN)

(72) Inventor: Song Wang, Chengdu (CN)

(73) Assignee: DONGGUAN HUIHUAN LIGHTING CO., LTD., Dongguan (CN)

( * ) Notice: Subject to any disclaimer, the term of this patent is extended or adjusted under 35 U.S.C. 154(b) by 0 days.

(21) Appl. No.: 17/244,926

(22) Filed: Apr. 29, 2021

(30) Foreign Application Priority Data

Dec. 9, 2020 (CN) ..... 202022927735.2

(51) Int. Cl.
*F21K 9/237* (2016.01)
*F21K 9/232* (2016.01)
*F21K 9/238* (2016.01)

(52) U.S. Cl.
CPC ..... *F21K 9/237* (2016.08); *F21K 9/232* (2016.08); *F21K 9/238* (2016.08)

(58) Field of Classification Search
CPC ..... F21K 9/237; F21K 9/232; F21K 9/238
See application file for complete search history.

(56) References Cited

U.S. PATENT DOCUMENTS 3,668,610 A * 6/1972 Flanagan ..... H01R 13/20 439/268
2005/0207176 A1* 9/2005 Johnson ..... B60Q 1/0088 362/545
2014/0363993 A1* 12/2014 Mochizuki ..... H01R 13/428 439/116
2015/0064950 A1* 3/2015 Wu ..... H01R 13/52 439/259

* cited by examiner

*Primary Examiner* — Evan P Dzierzynski

(57) ABSTRACT

The present invention relates to the technical field of bulbs, and discloses a bulb core column structure and a bulb with the bulb core column. The bulb core column structure comprises a plastic seat and at least one resistor a. The present invention has the following advantages: 1. the resistor is directly clamped on the plastic seat through structural change, and the clamping and fixing effect is good; 2. the assembly is simpler and is more suitable for mechanical automation, the resistor can be fixed after being directly inserted into the clamping seat without displacement, and the resistor is more stable for subsequent welding; and 3. the working procedure of pressing and fixing the resistor is reduced, thereby reducing manufacturing costs with stable product performance.

13 Claims, 3 Drawing Sheets

BULB CORE COLUMN STRUCTURE AND BULB WITH THE SAME

TECHNICAL FIELD

The present invention relates to the technical field of bulbs, in particular to a bulb core column structure and a bulb with the same.

BACKGROUND

Bulbs are the main lamps used for lighting. With the development of technology, a variety of bulbs have become common from conventional tungsten bulbs to the current LED chip bulbs and LED strip bulbs.

With the continuous improvement of production technology and intensified competition, manufacturers attach great importance to the reduction of production costs. For some bulbs using plastic core columns, it only needs to ensure that the plastic core columns can withstand when the bulbs are heating. The existing plastic core columns use reserved holes for metal wires of resistors to pass through, and then devices are used to pressurize the outside of the reserved holes to fix the metal wires and the resistors with plastic. However, such pressurization and fixation method is not reliable for fixing resistors, and the pressurization also produces manufacturing costs. Therefore, the inventor made an invention.

SUMMARY

In order to solve defects in the prior art, the purpose of the present invention is to provide a bulb core column structure and a bulb with the same. The bulb core column structure and the bulb with the same have the advantages of simple assembly, lower cost and good fixing effect.

In order to achieve the purpose, the present invention provides a bulb core column structure, comprising a plastic seat and at least one resistor a, wherein one end of the plastic seat is provided with a cavity with an opening, and the other end is provided with a projecting tongue, wherein the cavity is provided with a first clamping seat, and the projecting tongue is provided with a first guide hole in communication with the first clamping seat and a second guide hole in communication with the cavity; a first metal support wire is arranged at one end of the resistor a, and a second metal wire is arranged at the other end of the resistor a, the first metal support wire passes through the first clamping seat to the first guide hole in sequence, so that the resistor a is fixedly clamped in the first clamping seat, and the first metal support wire extends outward and is electrically connected with a light bar; and the second guide hole is provided with a second metal support wire electrically connected with the light bar.

Further, the cavity is provided with a second clamping seat, the second guide hole is in communication with the second clamping seat connected with a resistor b, the resistor b is fixedly clamped in the second clamping seat, and the second metal support wire is connected with the resistor b.

Preferably, the cavity is provided with a third clamping seat connected with a resistor c, the resistor c is fixedly clamped in the third clamping seat and connected with a third metal support wire, and the projecting tongue is provided with a third guide hole in communication with the third clamping seat.

Preferably, ends of the plastic seat extend along a wiring duct corresponding to the first clamping seat and the second clamping seat.

Further, the first clamping seat is a tubular seat and is provided with at least two V-shaped openings.

Further, the outer side of the plastic seat is provided with 4 to 8 projecting portions.

Further, the diameter of the first metal support wire is larger than that of the second metal wire or the thickness of the first metal support wire is larger than that of the second metal wire.

Further, the plastic seat is made of an elastic waterproof plastic.

The present invention further provides a bulb, comprising a lamp holder and a bulb shell, and further comprising the bulb core column, wherein the bulb core column is clamped with the bulb shell and electrically connected with the lamp holder, and the lamp holder is fixedly connected with the bulb shell; the bulb core column comprises a plastic seat and at least one resistor a, wherein one end of the plastic seat is provided with a cavity with an opening, and the other end is provided with a projecting tongue, wherein the cavity is provided with a first clamping seat, and the projecting tongue is provided with a first guide hole in communication with the first clamping seat and a second guide hole in communication with the cavity; a first metal support wire is arranged at one end of the resistor a, and a second metal wire is arranged at the other end of the resistor a, the first metal support wire passes through the first clamping seat to the first guide hole in sequence, so that the resistor a is fixedly clamped in the first clamping seat, and the first metal support wire extends outward and is electrically connected with a light bar; and the second guide hole is provided with a second metal support wire electrically connected with the light bar.

Advantageous Effects

Compared with the prior art, the bulb core column structure and the bulb with the bulb core column provided by the present invention comprise a plastic seat and at least one resistor a, wherein the first metal support wire passes through the first clamping seat to the first guide hole in sequence, so that the resistor a is fixedly clamped in the first clamping seat, and the first metal support wire extends outward and is electrically connected with a light bar. The present invention has the following advantages: 1. the resistor is directly clamped on the plastic seat through structural change, and the clamping and fixing effect is good; 2. the assembly is simpler and is more suitable for mechanical automation, the resistor can be fixed after being directly inserted into the clamping seat without displacement, and the resistor is more stable for subsequent welding; and 3. the working procedure of pressing and fixing the resistor is reduced, thereby reducing manufacturing costs with stable product performance.

Figure 1:
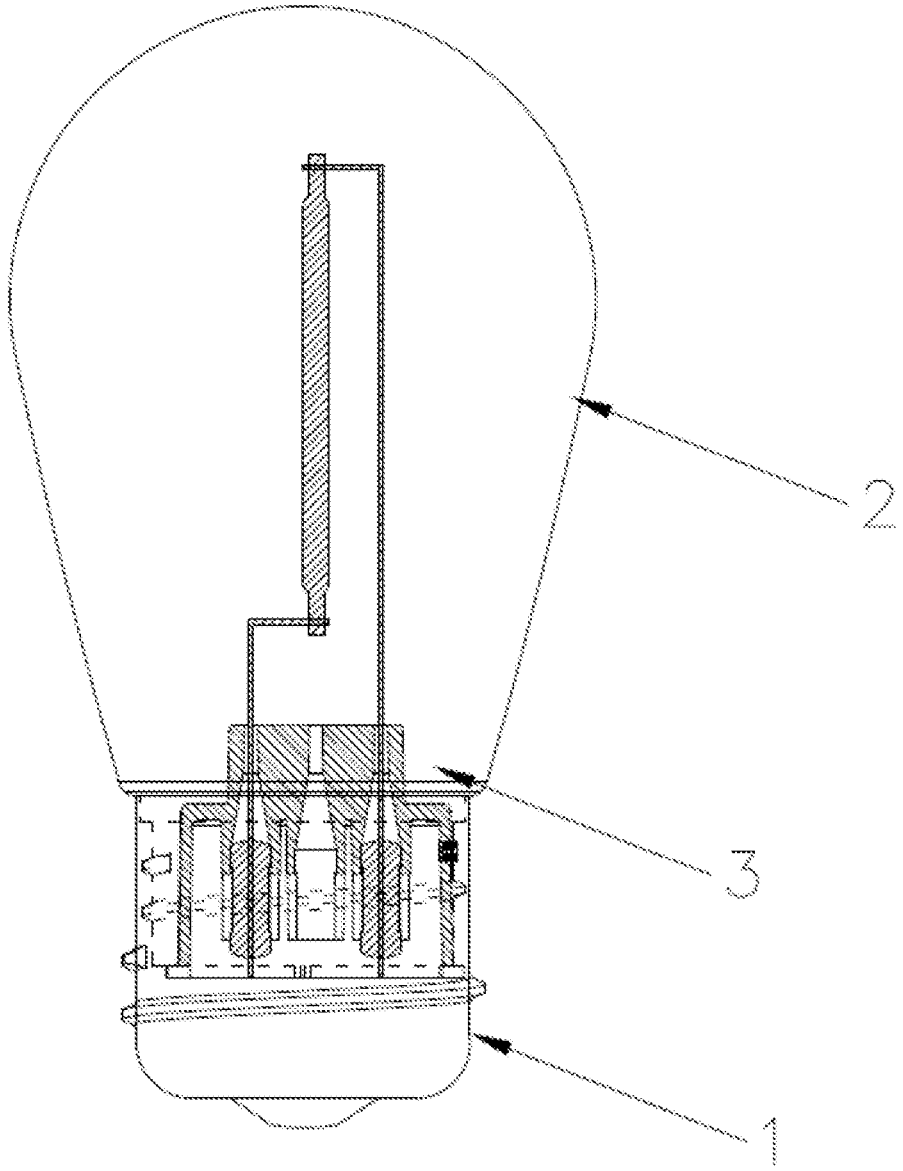
FIG. 1 is a structural diagram of a bulb of the present invention.
Figure 2:
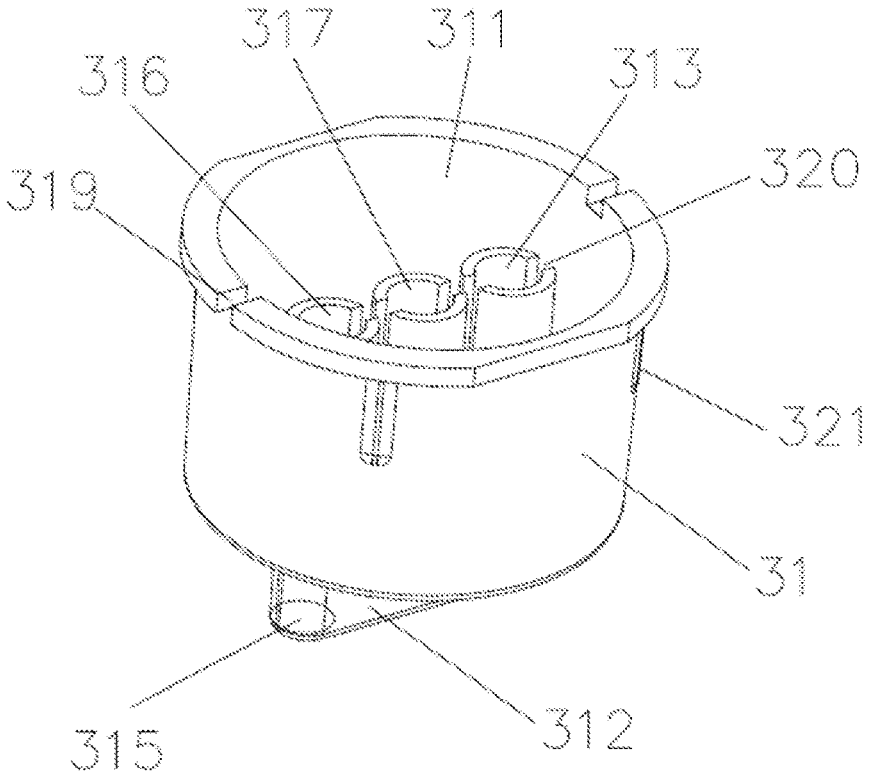
FIG. 2 is a perspective view of a plastic seat of the present invention.
Figure 3:
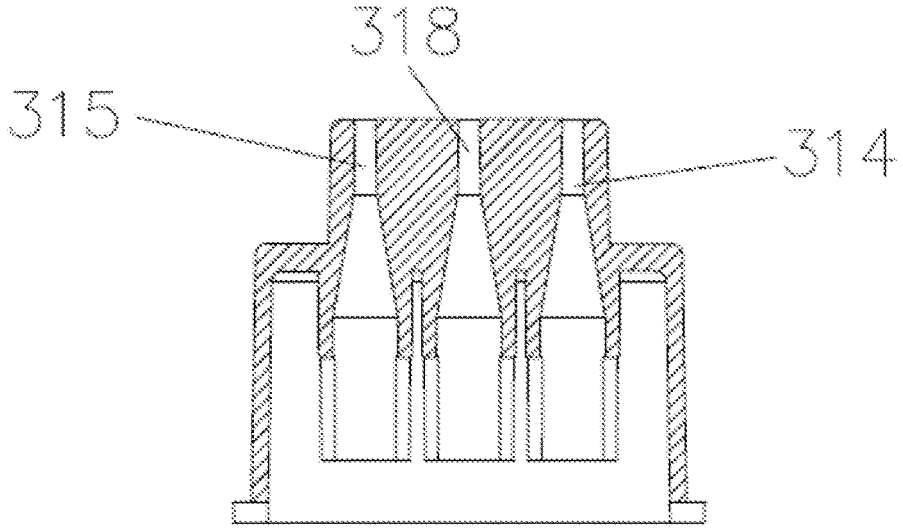
FIG. 3 is a sectional view of the plastic seat of the present invention.

Lamp holder—1, bulb shell—2, bulb core column—3, plastic seat—31, cavity—311, projecting tongue—312, first clamping seat—313, first guide hole—314, second guide hole—315, second clamping seat—316, third clamping seat—317, third guide hole—318, wiring duct—319, V-shaped openings—320, projecting portion—321, resistor a—4, first metal support wire—41, second metal wire—42, light bar—5, resistor b—6, resistor c—7.

DESCRIPTION OF THE INVENTION

The present invention will be described in detail with reference to FIGS. 1 to 5.

A bulb core column structure provided in embodiment 1 of the present invention comprises a plastic seat 31 and at least one resistor a4, wherein one end of the plastic seat is provided with a cavity 311 with an opening, and the other end is provided with a projecting tongue 312; wherein the cavity 311 is provided with a first clamping seat 313, and the projecting tongue is provided with a first guide hole 314 in communication with the first clamping seat 313 and a second guide hole 315 in communication with the cavity 311; a first metal support wire 41 is arranged at one end of the resistor a4 to provide support for a light bar 5, and a second metal wire 42 is arranged at the other end of the resistor a to achieve electrical connection, the first metal support wire 41 passes through the first clamping seat to the first guide hole in sequence, so that the resistor a is fixedly clamped in the first clamping seat 313, and the first metal support wire 41 extends outward and is electrically connected with the light bar that may be an LED light bar or other similar illuminant in the prior art; and the second guide hole is provided with a second metal support wire electrically connected with the light bar, and the second metal support wire and the first metal support wire form a support bracket. The bulb core column has the following advantages: 1. the resistor is directly clamped on the plastic seat through structural change, and the clamping and fixing effect is good; 2. the assembly is simpler, the resistor can be fixed after being directly inserted into the clamping seat without displacement, and the resistor is more stable for subsequent welding; and 3. the working procedure of pressing and fixing the resistor is reduced, thereby reducing manufacturing costs.

Figure 4:
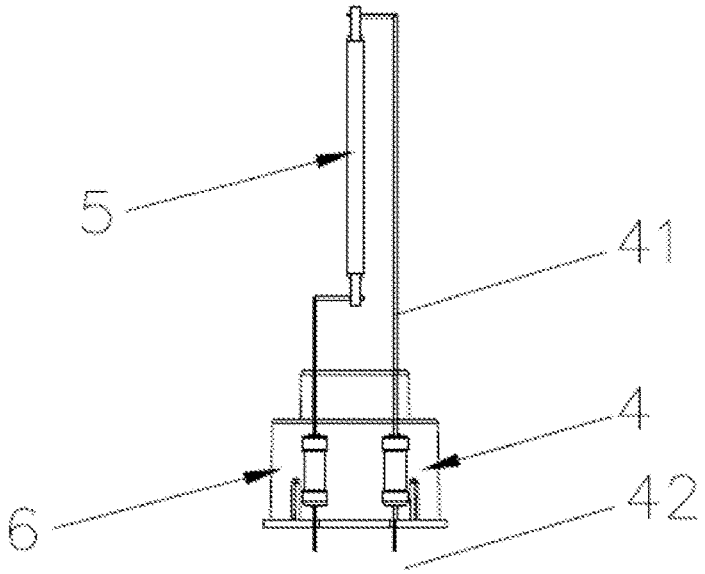
FIG. 4 is a structural diagram of embodiment 2 of the present invention.

As shown in FIG. 4, as an embodiment 2, the difference from other embodiments is that the cavity is provided with a second clamping seat 316, the second guide hole 315 is in communication with the second clamping seat 316 connected with a resistor b6, the resistor b6 is fixedly clamped in the second clamping seat 316, and the second metal support wire is connected with the resistor b6. In the embodiment, the bulb core column is provided with two resistors, so that the lamp has better performance, and the dual resistors have better heat dissipation performance compared with that of a single resistor. It should be emphasized that when the single resistor solution in embodiment 1 is used, which is not shown in the accompanying drawings, only one resistor is needed on the basis of FIG. 1 or FIG. 4.

Figure 5:
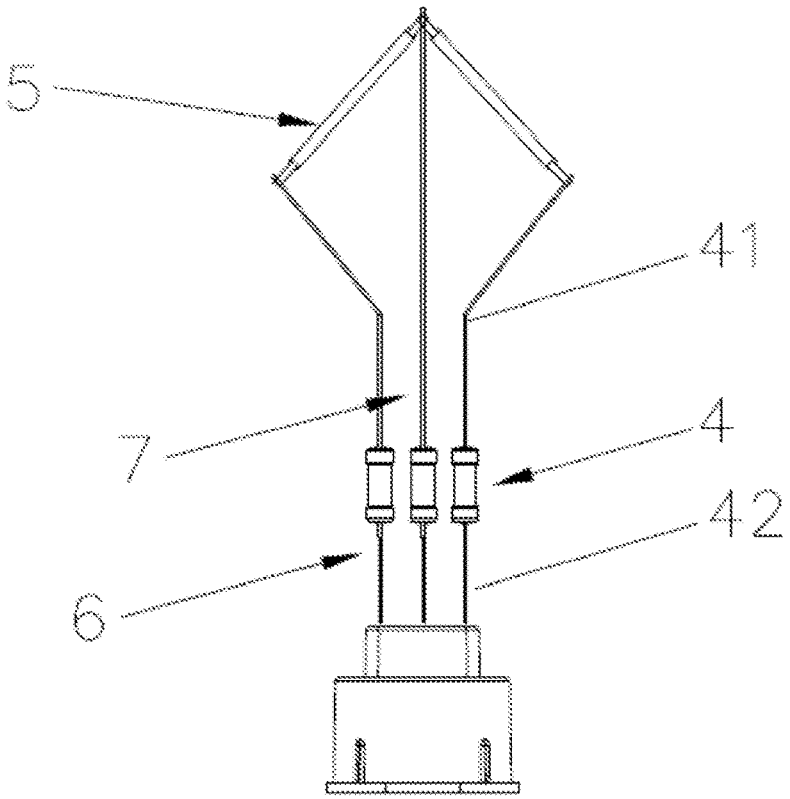
FIG. 5 is a schematic diagram of embodiment 3 of the present invention.

As shown in FIG. 5, as another embodiment 3, the difference from other embodiments is that when a plurality of light bars 5 are to be connected with the lamp, the cavity is provided with a third clamping seat 317 connected with a resistor c7, the resistor c is fixedly clamped in the third clamping seat 317 and connected with a third metal support wire, and the projecting tongue is provided with a third guide hole in communication with the third clamping seat. In the embodiment, three resistors are used, so that it is easy to arrange a plurality of light bars in the lamp to form different luminous patterns.

In order to facilitate electrical connection between the second metal wire of the resistor and the lamp holder, ends of the plastic seat extend along a wiring duct 319 corresponding to the first clamping seat 313 and the second clamping seat 316.

In the technical solution, the first clamping seat 313 is a tubular seat and is provided with at least two V-shaped openings 320. Such V-shaped openings 320 have flexibility of installation compared with an integral tubular structure, which can prevent damage to the resistor during automatic assembly, and are also beneficial to defective products in the production process. The flexibility resulting from the V-shaped openings 320 can be utilized to pull out the resistor back for repair of defective products.

In order to enable the bulb core column to better fit with the bulb shell during assembly, the outer side of the plastic seat is provided with 4 to 8 projecting portions 321. Gap wobble can be reduced by using the projecting portions 321.

In the technical solution, the diameter of the first metal support wire 41 is larger than that of the second metal wire 42 or the thickness of the first metal support wire 41 is larger than that of the second metal wire 42, so that the support strength of the first metal support wire can be maximized, and the use of the second metal wire can minimize the manufacturing cost.

In the solution, the plastic seat 31 is made of an elastic waterproof plastic. The elastic waterproof plastic can prevent water from entering the bulb, and is of great value for the production of waterproof bulbs.

As shown in FIG. 1, the present invention further provides a bulb, comprising a lamp holder 1 and a bulb shell 2, and further comprising the bulb core column 3, wherein the bulb core column 3 is clamped with the bulb shell 2, the bulb core column 3 is electrically connected with the lamp holder 1, and the lamp holder is fixedly connected with the bulb shell. The bulb has the same technical effect as the bulb core column.

The above contents are only preferred embodiments of the present invention. For those of ordinary skill in the art, there will be changes in specific embodiments and application scope according to the idea of the present invention, the contents of the specification should not be construed as a limitation to the present invention.

The invention claimed is:

1. A bulb core column structure, comprising a plastic seat and at least one resistor a, wherein one end of the plastic seat is provided with a cavity with an opening, and the other end is provided with a projecting tongue, wherein the cavity is provided with a first clamping seat, and the projecting tongue is provided with a first guide hole in communication with the first clamping seat and a second guide hole in communication with the cavity; a first metal support wire is arranged at one end of the resistor a, and a second metal wire is arranged at the other end of the resistor a, the first metal support wire passes through the first clamping seat to the first guide hole in sequence, so that the resistor a is fixedly clamped in the first clamping seat, and the first metal support wire extends outward and is electrically connected with a light bar; and the second guide hole is provided with a second metal support wire electrically connected with the light bar.

2. The bulb core column structure according to claim 1, wherein the cavity is provided with a second clamping seat, the second guide hole is in communication with the second clamping seat connected with a resistor b, the resistor b is fixedly clamped in the second clamping seat, and the second metal support wire is connected with the resistor b.

3. The bulb core column structure according to claim 2, wherein the cavity is provided with a third clamping seat connected with a resistor c, the resistor c is fixedly clamped in the third clamping seat and connected with a third metal support wire, and the projecting tongue is provided with a third guide hole in communication with the third clamping seat.

4. The bulb core column structure according to claim 2, wherein ends of the plastic seat extend along a wiring duct corresponding to the first clamping seat and the second clamping seat.

5. A bulb, comprising a lamp holder and a bulb shell, and further comprising the bulb core column according to claim 2, wherein the bulb core column is clamped with the bulb shell and electrically connected with the lamp holder, and the lamp holder is fixedly connected with the bulb shell.

6. The bulb core column structure according to claim 1, wherein the first clamping seat is a tubular seat and is provided with at least two V-shaped openings.

7. A bulb, comprising a lamp holder and a bulb shell, and further comprising the bulb core column according to claim 6, wherein the bulb core column is clamped with the bulb shell and electrically connected with the lamp holder, and the lamp holder is fixedly connected with the bulb shell.

8. The bulb core column structure according to claim 1, wherein the outer side of the plastic seat is provided with 4 to 8 projecting portions.

9. A bulb, comprising a lamp holder and a bulb shell, and further comprising the bulb core column according to claim 8, wherein the bulb core column is clamped with the bulb shell and electrically connected with the lamp holder, and the lamp holder is fixedly connected with the bulb shell.

10. The bulb core column structure according to claim 1, wherein the diameter of the first metal support wire is larger than that of the second metal wire or the thickness of the first metal support wire is larger than that of the second metal wire.

11. A bulb, comprising a lamp holder and a bulb shell, and further comprising the bulb core column according to claim 10, wherein the bulb core column is clamped with the bulb shell and electrically connected with the lamp holder, and the lamp holder is fixedly connected with the bulb shell.

12. The bulb core column structure according to claim 1, wherein the plastic seat is made of an elastic waterproof plastic.

13. A bulb, comprising a lamp holder and a bulb shell, and further comprising the bulb core column according to claim 1, wherein the bulb core column is clamped with the bulb shell and electrically connected with the lamp holder, and the lamp holder is fixedly connected with the bulb shell.

* * * * *